US009238367B2

(12) United States Patent
Kato

(10) Patent No.: US 9,238,367 B2
(45) Date of Patent: Jan. 19, 2016

(54) DROPLET DISCHARGING HEAD AND IMAGE FORMING APPARATUS

(71) Applicant: Masaki Kato, Tokyo (JP)

(72) Inventor: Masaki Kato, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 37 days.

(21) Appl. No.: 14/207,910

(22) Filed: Mar. 13, 2014

(65) Prior Publication Data

US 2014/0267499 A1 Sep. 18, 2014

(30) Foreign Application Priority Data

Mar. 15, 2013 (JP) ..... 2013-054297
Oct. 21, 2013 (JP) ..... 2013-218350

(51) Int. Cl.

| | |
|---|---|
| ***B41J 2/14*** | (2006.01) |
| ***B41J 2/05*** | (2006.01) |
| ***B41J 2/045*** | (2006.01) |
| ***B41J 2/16*** | (2006.01) |

(52) U.S. Cl.

CPC ..... *B41J 2/14233* (2013.01); *B41J 2/161* (2013.01); *B41J 2/1623* (2013.01); *B41J 2/1625* (2013.01); *B41J 2/1628* (2013.01); *B41J 2/1629* (2013.01); *B41J 2/1631* (2013.01); *B41J 2/1632* (2013.01); *B41J 2/1634* (2013.01); *B41J 2/1642* (2013.01); *B41J 2/1643* (2013.01); *B41J 2/1646* (2013.01); *B41J 2002/14491* (2013.01)

(58) Field of Classification Search

CPC ..... B41J 2/1634; B41J 2/1642; B41J 2/1643; B41J 2/1646; B41J 2002/14491; B41J 2/14702; B41J 2/14129; B41J 2/14233; B41J 2/14209; B41J 2002/14225

See application file for complete search history.

(56) References Cited

U.S. PATENT DOCUMENTS

| | | | | |
|---|---|---|---|---|
| 4,520,374 | A * | 5/1985 | Koto | 347/48 |
| 4,673,966 | A * | 6/1987 | Shimoyama | 257/211 |
| 4,685,033 | A * | 8/1987 | Inoue | 361/794 |
| 4,701,778 | A * | 10/1987 | Aneha et al. | 257/207 |
| 5,311,218 | A * | 5/1994 | Ochiai et al. | 347/71 |
| 5,929,881 | A * | 7/1999 | Kitahara et al. | 347/70 |
| 7,364,273 | B2 * | 4/2008 | Takahashi | 347/68 |
| 7,559,631 | B2 * | 7/2009 | Shimada et al. | 347/64 |

(Continued)

FOREIGN PATENT DOCUMENTS

| | | | |
|---|---|---|---|
| JP | 04077257 | A * | 3/1992 |
| JP | 05261921 | A * | 10/1993 |

(Continued)

*Primary Examiner* — Anh T. N. Vo
(74) *Attorney, Agent, or Firm* — IPUSA, PLLC

(57) ABSTRACT

A droplet discharging head includes a passage substrate in which individual liquid chambers are formed; a plurality of piezoelectric elements formed on the passage substrate; a plurality of wirings for connecting electrodes of the plurality of piezoelectric elements and drive circuit connecting portions for being connected to a drive circuit, respectively, formed on the passage substrate; and a support substrate, formed on the passage substrate, provided with a concave portion for housing the plurality of piezoelectric elements at a surface facing the passage substrate, the support substrate being provided with an opening portion above the drive circuit connecting portions, wherein the support substrate is adhered to the passage substrate at a support substrate adhering region of the passage substrate including area where the wirings are formed, and wherein a wiring space between each adjacent wirings is formed to have a crank portion at the support substrate adhering region.

12 Claims, 11 Drawing Sheets

(56) References Cited

U.S. PATENT DOCUMENTS

| | | | | |
|---|---|---|---|---|
| 8,414,110 | B2 * | 4/2013 | Kato et al. | 347/50 |
| 8,454,133 | B2 | 6/2013 | Mizukami et al. | |
| 8,491,103 | B2 * | 7/2013 | Kato et al. | 347/68 |
| 8,556,396 | B2 * | 10/2013 | Kato et al. | 347/85 |
| 8,602,530 | B2 * | 12/2013 | Mizukami et al. | 347/50 |
| 8,646,870 | B2 | 2/2014 | Nishimura et al. | |
| 8,657,418 | B2 | 2/2014 | Kato et al. | |
| 2006/0209136 | A1 * | 9/2006 | Takahashi | 347/68 |
| 2012/0069101 | A1 * | 3/2012 | Kato et al. | 347/70 |
| 2012/0206545 | A1 * | 8/2012 | Kato et al. | 347/70 |
| 2012/0229573 | A1 * | 9/2012 | Mizukami et al. | 347/50 |
| 2013/0021412 | A1 * | 1/2013 | Nishimura et al. | 347/68 |
| 2014/0362141 | A1 * | 12/2014 | Nakao et al. | 347/71 |

FOREIGN PATENT DOCUMENTS

| | | | | |
|---|---|---|---|---|
| JP | 06316065 | A | * | 11/1994 |
| JP | 08267745 | A | * | 10/1996 |
| JP | 2001010040 | A | * | 1/2001 |
| JP | 2003-127365 | | | 5/2003 |
| JP | 2004-160947 | | | 6/2004 |
| JP | 2008-229985 | | | 10/2008 |
| JP | 2012-061750 | | | 3/2012 |
| WO | WO 9903682 | A1 | * | 1/1999 |

* cited by examiner

DROPLET DISCHARGING HEAD AND IMAGE FORMING APPARATUS

BACKGROUND OF THE INVENTION

1. Field of the Invention

The present invention relates to a droplet discharging head and an image forming apparatus.

2. Description of the Related Art

Recently, ink-jet printers are required to have a high-speed and high quality printing performance and also required to be smaller, space-saving, and lower price. Thus, it is necessary for a droplet discharging head, which is a main component of the ink-jet printer, to be highly integrated and smaller. Therefore, a technique to apply a Micro Electro-Mechanical System (MEMS) method to droplet discharging heads has been developed.

In particular, the MEMS method has been applied to a unimorph type droplet discharging head using a piezoelectric actuator because the unimorph type droplet discharging head can provide a high drive force by a thin film piezoelectric material, simple electrodes and a diaphragm (see Patent Documents 1 to 4, for example).

However, as will be explained later in detail with reference to FIG. 3, there has been a problem in that a space may be generated between a support substrate and a passage substrate depending on the shape of lead wirings or the amount of an adhesive agent due to a wiring step of the lead wirings. Then, if a sealing material, air, water or the like enters into a vibration room for a piezoelectric actuator, the performance of the piezoelectric actuator may be lowered.

For example, in Patent Document 2, a technique is disclosed in which a protection substrate is provided with a concave housing portion for housing an adhesive agent at a region facing a portion between lead electrodes at an adhering surface that is adhered to the lead electrodes.

Further, for example, in Patent Document 3, a method is disclosed in which a passage substrate and a sealing substrate are adhered with each other by an adhesive agent including particle insulating objects. It is said that the amount of the adhesive agent that flows out is regulated by the insulating objects.

By the technique disclosed in Patent Document 2, the adhesive agent is only introduced into the concave housing portion and generation of such a space as described above cannot be sufficiently suppressed. Thus, when the space is generated due to a step of the lead electrodes, the sealing material, air, water or the like cannot be prevented from entering into the vibration room for the piezoelectric actuator.

Further, in Patent Document 3, generation of the space between the passage substrate and the sealing substrate is not recognized and generation of the space cannot be sufficiently suppressed. Thus, the sealing material, air, water or the like cannot be prevented from entering into the vibration room for the piezoelectric actuator. Further, as there is a large limitation in the adhesive agent, it is difficult to make the thickness of the adhesive agent thin. Thus, there is a problem in improving rigidity that is necessary for driving the droplet discharging head at a high-speed.

PATENT DOCUMENT

[Patent Document 1] Japanese Laid-open Patent Publication No. 2012-061750

[Patent Document 2] Japanese Laid-open Patent Publication No. 2008-229985

[Patent Document 3] Japanese Laid-open Patent Publication No. 2004-160947

[Patent Document 4] Japanese Laid-open Patent Publication No. 2003-127365

SUMMARY OF THE INVENTION

The present invention is made in light of the above problems, and provides a droplet discharging head capable of suppressing generation of a space between a support substrate and a passage substrate due to a wiring step, even when the mount of the adhesive agent is small, and capable of suppressing the flow of a sealing material from a drive circuit connecting portion toward a vibration room even when the space due to the wiring step is generated.

According to an embodiment, there is provided a droplet discharging head including a passage substrate in which individual liquid chambers are formed; a plurality of piezoelectric elements formed on the passage substrate; a plurality of wirings for connecting electrodes of the plurality of piezoelectric elements and drive circuit connecting portions for being connected to a drive circuit, respectively, formed on the passage substrate; and a support substrate, formed on the passage substrate, provided with a concave portion for housing the plurality of piezoelectric elements at a surface facing the passage substrate, the support substrate being provided with an opening portion above the drive circuit connecting portions, wherein the support substrate is adhered to the passage substrate at a support substrate adhering region of the passage substrate including area where the wirings are formed, and wherein a wiring space between each adjacent wirings is formed to have a crank portion at the support substrate adhering region.

Note that also arbitrary combinations of the above-described elements, and any changes of expressions in the present invention, made among methods, devices, systems and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Before describing the present invention, a general structure of a droplet discharging head will be explained with reference to FIG. 1 to FIG. 4B in order to facilitate the understanding of the present invention.

Figure 1:
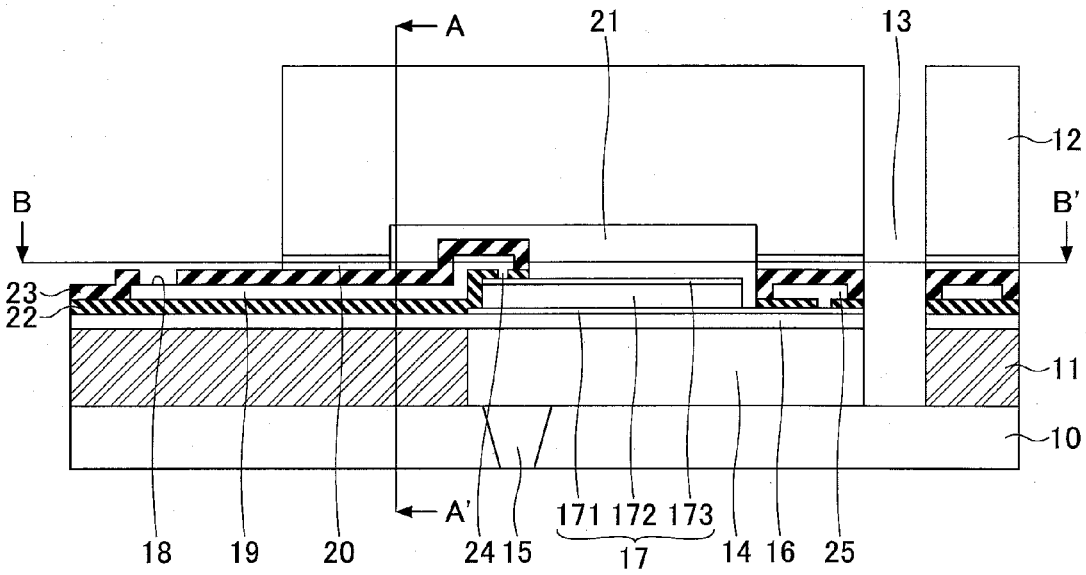
FIG. 1 is a cross-sectional view illustrating an example of a structure of a droplet discharging head using a unimorph type piezoelectric actuator.
Figure 2B:
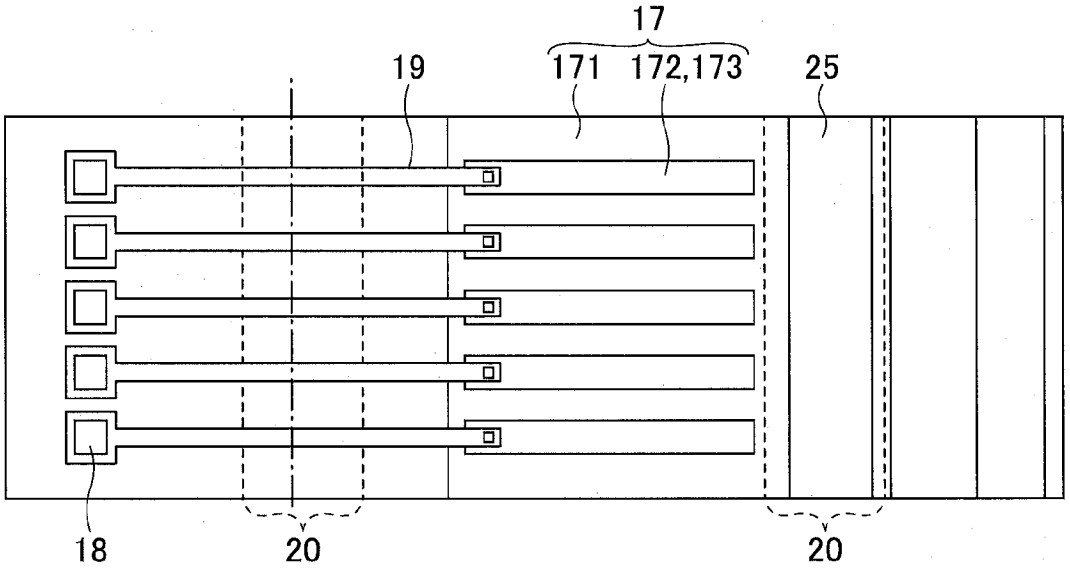
FIG. 2B is a cross-sectional view taken along a B-B' line in FIG. 1.
Figure 2A:
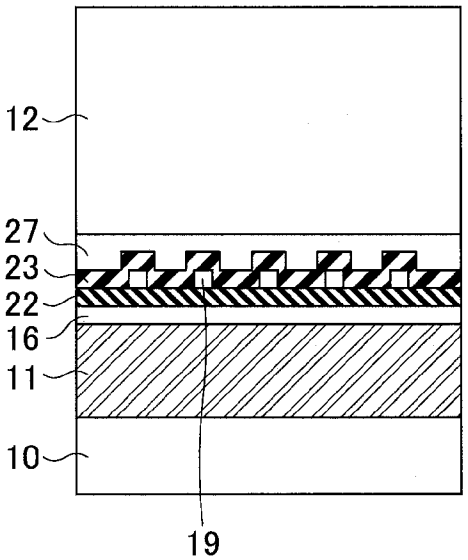
FIG. 2A is a cross-sectional view taken along an A-A' line in FIG. 1.

FIG. 1 is a cross-sectional view illustrating an example of a structure of a droplet discharging head using a unimorph type piezoelectric actuator. FIG. 2A is a cross-sectional view illustrating an example of a structure of a general droplet discharging head taken along an A-A' line in FIG. 1. FIG. 2B is a cross-sectional view illustrating an example of a structure of the general droplet discharging head taken along a B-B' line in FIG. 1.

The droplet discharging head includes a nozzle plate 10, a passage substrate 11, a support substrate 12, an ink supplying passage (common passage) 13, a plurality of individual liquid chambers 14, a plurality of nozzles 15, a plurality of piezoelectric actuators (piezoelectric elements) 17, a plurality of drive circuit connecting portions 18, a plurality of lead wirings 19, a vibration room 21, interlayer insulating films 22 and 23, a plurality of connecting portions 24, a common electrode wiring 25 and the like. The lead wirings 19 as illustrated includes individual electrode wirings and a common electrode wiring that is extended from the common electrode wiring 25 (in other words, that is a part of the common electrode wiring 25).

The nozzle plate 10, the passage substrate 11 and the support substrate 12 are stacked in this order and bonded with each other. The support substrate 12 is provided for giving intensity to the droplet discharging head and protecting the piezoelectric actuators 17.

The piezoelectric actuator 17 includes a diaphragm (vibration plate) 16, an upper electrode 172, a piezoelectric body 173 and a lower electrode 171. The piezoelectric actuators 17 are connected to a drive circuit (41, see FIG. 4A or FIG. 4B) via the lead wirings 19 and the drive circuit connecting portions 18, respectively.

Specifically, for each of the piezoelectric actuators 17, the upper electrode 173 is led to the drive circuit connecting portion 18 via the lead wiring 19 (individual electrode wiring) and the lower electrode 171 is led to the drive circuit connecting portion 18 via the common electrode wiring 25 and the lead wiring 19.

The drive circuit connecting portions 18 are provided at an opening portion of the support substrate 12.

As illustrated in FIG. 2B, each set of the piezoelectric actuator 17, the lead wiring 19 and the drive circuit connecting portion 18 is provided to extend in a lateral direction. The sets are aligned in a direction perpendicular to the lateral direction with a space therebetween. The lead wirings 19 are provided to extend across a support substrate adhering region 20 that is an adhering region of the passage substrate 11 and the support substrate 12 to be led to the drive circuit connecting portions 18, respectively.

As illustrated in FIG. 2A, the lead wirings 19 are provided to have a space between adjacent lead wirings 19 in order to insulate the adjacent lead wirings 19. Further, the interlayer insulating films 22 and 23 are provided below and above the lead wirings 19, respectively.

Here, as illustrated in FIG. 2A, the support substrate 12 is adhered to the passage substrate 11 by an adhesive agent 27 via the diaphragm 16, the interlayer insulating film 22, the lead wirings 19 and the interlayer insulating film 23 at the support substrate adhering region 20 (see FIG. 2B).

Figure 3:
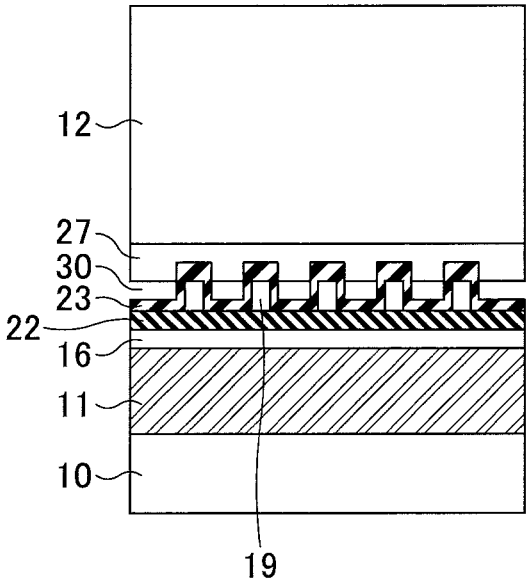
FIG. 3 is a view illustrating an example of a structure of general lead wirings at a support substrate adhering region.

With this structure, there is a problem, as illustrated in FIG. 3, in that a space 30 may be generated between the support substrate 12 and the passage substrate 11 depending on the shape of the lead wirings 19 or the amount of the adhesive agent 37 due to a wiring step of the lead wirings 19.

In particular, recently, as described above, the ink-jet printers are required to have a high-speed printing performance. Thus, it is necessary for a droplet discharging head to have a high discharging frequency. In order to correspond to such a high discharging frequency, a droplet discharging head with a high rigidity is required. As the rigidity of the adhesive agent is weak, it is required to make the thickness of the adhesive agent as thin as possible. Therefore, when the thickness of the adhesive agent is thin, the wiring step is easily reflected to an adhering surface to cause the generation of the space 30 as illustrated FIG. 3.

Figure 4A:
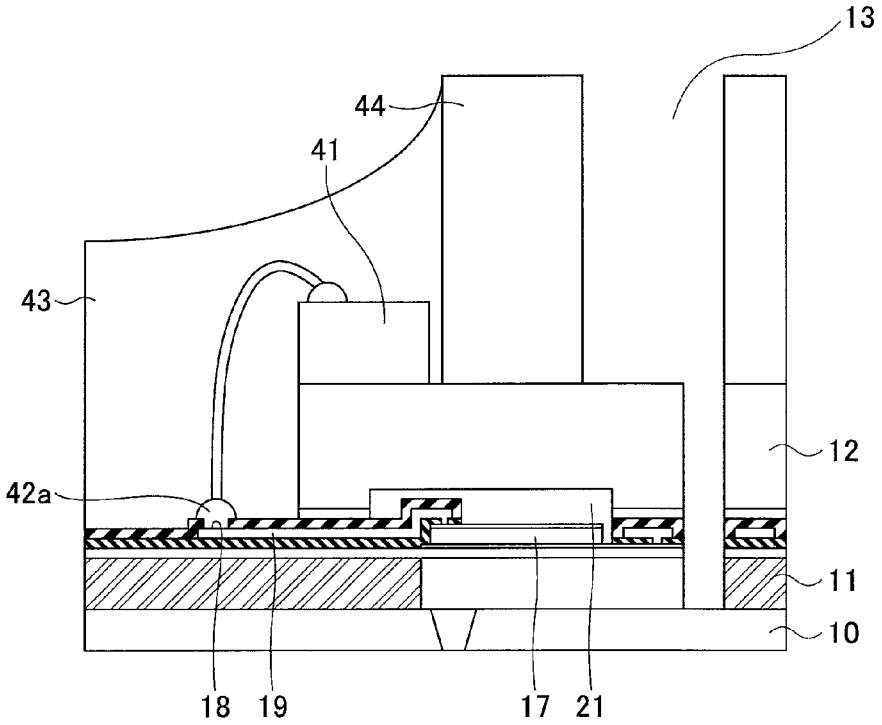
FIG. 4A and FIG. 4B are views illustrating an example of a structure in which a sealing material is provided near drive circuit connecting portions.
Figure 4B:
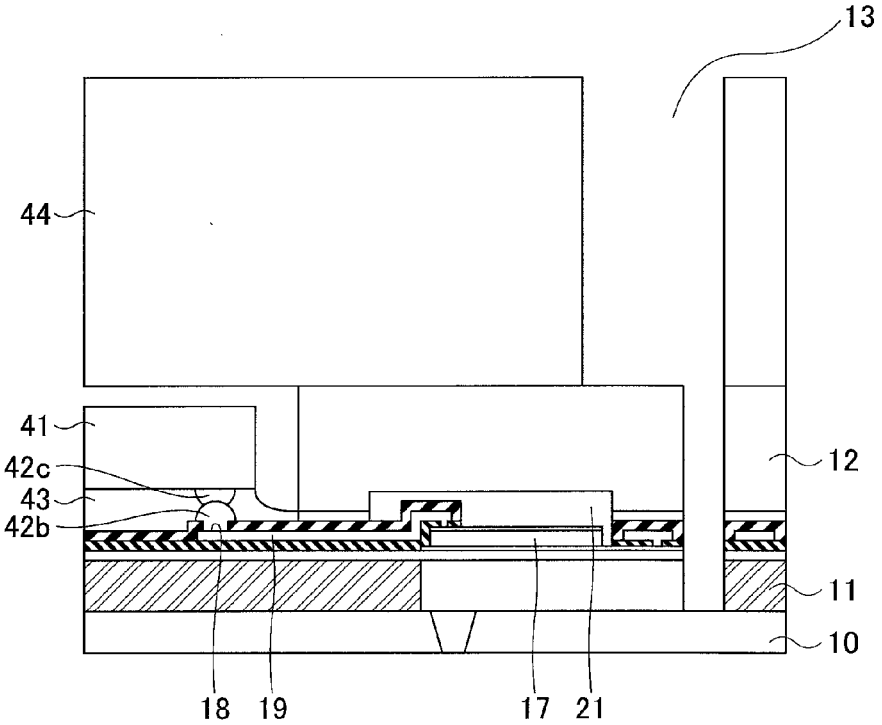

When mounting a drive circuit 41 on the droplet discharging head, wire bonding is used as illustrated in FIG. 4A, or a flip chip connection is used as illustrated in FIG. 4B. At both cases, as illustrated in FIG. 4A and FIG. 4B, a sealing material 43 is coated or filled in order to protect the drive circuit connecting portion 18. When there is the space 30 between the support substrate 12 and the passage substrate 11 as illustrated in FIG. 3 at this time, the sealing material 43 enters into the vibration room 21 by capillary attraction. If the sealing material 43 enters into the vibration room 21, the sealing material 43 is deposited on the piezoelectric actuators 17 to lower the performance of the piezoelectric actuators 17.

Further, for a unimorph type piezoelectric actuator, the piezoelectric body 172 is a thin film and electric field applied to the piezoelectric body 172 is high. Thus, high dielectric voltage is required for the piezoelectric body 172. Thus, if the space 30 is generated between the support substrate 12 and the passage substrate 11 as illustrated in FIG. 3 and air, water or the like enters into the vibration room 21, the piezoelectric body 172 may be damaged by water or the like, which causes a generation of dielectric voltage failure. In such a case, ink may not be discharged from the nozzle 15.

The invention will be now described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

(First Embodiment)

In this embodiment, a droplet discharging head is explained.

The droplet discharging head of the embodiment includes a passage substrate in which individual liquid chambers are formed; a plurality of piezoelectric elements formed on the passage substrate; a plurality of wirings for connecting electrodes of the plurality of piezoelectric elements and drive circuit connecting portions for being connected to a drive circuit, respectively, formed on the passage substrate; and a support substrate, formed on the passage substrate, provided with a concave portion for housing the plurality of piezoelectric elements at a surface facing the passage substrate, the support substrate being provided with an opening portion above the drive circuit connecting portions, wherein the support substrate is adhered to the passage substrate at a support substrate adhering region of the passage substrate including area where the wirings are formed, and wherein a wiring space between each adjacent wirings is formed to have a crank portion at the support substrate adhering region.

A structure of the droplet discharging head of the embodiment is explained with reference to FIG. 1. FIG. 1 is a cross-sectional view illustrating an example of the droplet discharging head including the unimorph type piezoelectric actuator, as described above.

Here, although an example is described in the following in which ink is used as liquid, the liquid capable of being used for the droplet discharging head of the embodiment is not limited to ink, and may be arbitrarily selected based on the purpose or the like.

Each part is explained in detail in the following.

(Nozzle Plate)

The nozzle plate 10 is a plate provided with the nozzles 15. The nozzles 15 are provided to correspond to the individual liquid chambers 14 that are formed at the passage substrate 11 to be in communication with the individual liquid chambers 14, respectively.

The material of the nozzle plate 10 is not specifically limited, and various materials such as metal/alloy, a dielectric material, semiconductor, resin or the like may be used, for example. The material of the nozzle plate 10 may be selected in accordance with a method of processing.

When metal/alloy is used, Ni, Cu or the like may be used because in this case, the nozzles 15 or the like can be formed into a desired shape by electroforming, for example. Further, stainless steel (hereinafter, referred to as "SUS" as well) may be used because in this case, the nozzles 15 or the like can be formed into a desired shape by machining or laser processing, for example. Further, metal/alloy with a high corrosion resistance against ink may be preferably used. Specifically, SUS may be preferably used, for example.

For a dielectric material, glass or any ceramics materials may be used. In this case, the nozzles 15 or the like can be formed into a desired shape by etching, laser ablation or the like.

For semiconductor, a silicon (Si) wafer may be used. In this case, the nozzles 15 or the like can be formed into a desired shape by a semiconductor process technique such as photolithography.

For resin, the material is not specifically limited, and the nozzles 15 or the like can be formed into a desired shape by a method using a photosensitive material such as a dry film resist or the like or a laser processing.

The thickness of the nozzle plate 10 and the shape of the nozzles 15 may be arbitrarily determined in accordance with desired characteristics. However, for example, the thickness of the nozzle plate 10 may be within a range of 10 to 100 μm from the point of view of processability (productivity) and discharging efficiency of the nozzles 15. When the thickness of the nozzle plate 10 is too thin, as rigidity is not enough, productivity is lowered and discharging efficiency is also lowered because intensity is not enough against pressure generated when discharging. On the other hand, when the thickness of the nozzle plate 10 is too thick, productivity in processing the nozzles 15 such as press processing, laser processing or the like is significantly lowered.

The diameter of the nozzle 15 may be determined based on a desired discharging drop rate and a desired discharging volume, and is not specifically limited. However, the diameter of the nozzle 15 may be within a range of 10 to 40 μm, and more preferably, within a range of 15 to 25 μm.

The cross-sectional shape of the nozzle 15 may be arbitrarily determined based on the processing method and may be a tapered shape, a round shape, a straight shape or the like, for example. A discharging surface of the nozzle 15 may be performed with an ink-repellent process. By coating or depositing a general water-repellent material or oil-repellant material, discharging efficiency and discharging stability can be improved. The method of bonding the nozzle plate 10 and the passage substrate 11 is not specifically limited, but the nozzle plate 10 and the passage substrate 11 may be bonded by an adhesive agent, for example. The adhesive agent is not specifically limited and may be selected based on a required durability or the like.

(Passage Substrate)

As described above, the individual liquid chambers 14 that are in communication with the nozzles 15, respectively, and the ink supplying passage 13 are formed in the passage substrate 11. Further, the piezoelectric actuators 17 formed on the individual liquid chambers 14 and the lead wirings 19 (individual electrode wiring and/or common electrode wiring) that supply drive signals to the piezoelectric actuators 17, respectively, are formed on the passage substrate 11.

With the above structure, when the piezoelectric actuator 17 is driven, the diaphragm 16 is deformed, which causes a pressure variation of ink in the respective individual liquid chamber 14 to discharge the ink from the nozzle 15.

The material of the passage substrate 11 is not specifically limited. However, in order to manufacture a unimorph type piezoelectric actuator with a high-density, a Si wafer may be used.

The individual liquid chambers 14 may be formed in the passage substrate 11 by any methods. When the Si wafer is used as the passage substrate 11, as described above, photolithography that is commonly used as the semiconductor process technique may be used.

The individual liquid chambers 14 may be dug by an etching process such as wet etching using chemical solution such as KOH or TMAH, dry etching using plasma, or the like.

When the wet etching is used, productivity is high due to a batch processing and the processing with a high accuracy by anisotropic etching using differences in etching speed by crystal orientation can be obtained. However, the shape is limited by a crystal plane.

When the dry etching is used, productivity is low due to a single wafer processing. However, the individual liquid chambers 14 may be formed into an arbitrary shape because there is no limitation in layout of the crystal orientation. Thus, the method of processing may be selected by considering process accuracy, productivity or the like.

The thickness of the passage substrate 11 that determines the height of the individual liquid chambers 14 may be within a range of 40 to 100 μm. By making the thickness of the passage substrate 11 less than or equal to 100 μm, pressure loss due to compliance of ink and lowering of productivity due to increasing of etching period can be suppressed. Further, by making the thickness of the passage substrate 11 more than or equal to 40 μm, intensity of the passage substrate 11 can be retained so that damage to the passage substrate 11 can be effectively suppressed.

The diaphragms 16 may be formed on at least above the individual liquid chambers 14 on the passage substrate 11 and may be formed on the entirety of the passage substrate 11 except portions at which the ink supplying passage 13 and the individual liquid chambers 14 are connected. With this structure, the height of an adhering surface with the support substrate 12 can be easily made uniform.

The material of the diaphragm 16 is not specifically limited and may be any materials capable of being formed above the passage substrate 11. When the passage substrate 11 is made of Si wafer, the material of the diaphragm 16 may be any material capable of being formed above the Si wafer. Specifically, the material of the diaphragm 16 may be a Si containing compound such as polycrystalline Si, amorphous Si, $SiO_2$, $Si_3N_4$, SiC or the like, an oxide compound such as $Al_2O_3$, $ZrO_2$ $TiO_2$, $Ta_2O_5$, ZnO, $Y_2O_3$ or the like, a nitride compound such as AlN, TiN or the like, or a composite compound of these.

The diaphragm 16 may be deposited using a thin film deposition technique on the Si wafer, and CVD, ALD, sputtering or the like may be used.

The thickness of the diaphragm 16 may be arbitrarily determined based on physical properties (Young's modulus, Poisson's ratio or the like) of the material and a desired vibration characteristics, but may be within a range of 1 to 5 μm, and more preferably, within a range of 1 to 3 μm. When the thickness of the diaphragm 16 is more than or equal to the above lower limit range, generation of damage due to crack of the diaphragm 16 can be prevented. On the other hand, when the thickness of the diaphragm 16 is less than or equal to the above upper limit range, lowering of vibration deformation can be prevented so that lowering of discharging efficiency (discharging energy with respect to voltage) can be prevented.

Then, as described above, the lower electrode 171, the piezoelectric body 172 and the upper electrode 173 may be formed on the diaphragm 16.

The material of the lower electrode 171 and the upper electrode 173 may be selected from any materials as long as it is a conductive material.

The material of the lower electrode 171 and the upper electrode 173 may be metal, alloy or a conductive compound. As the structure is performed with a heat treatment of 500 to 800° C. for baking or the like after depositing the piezoelectric body 172, the material having a high melting point and of a high stable may be used for the lower electrode 171 and the upper electrode 173. For such a material, noble metal such as Au, Rh, Pt, Ir or Pd, alloy of these, an oxide compound of these may be used. Further, a multi-layer of a plurality of materials selected from them may be used.

The thickness of the upper electrode 173 or the lower electrode 171 may be arbitrarily determined but may be a thickness that does not influence the deformation of the piezoelectric body 172. The thickness of the upper electrode 173 or the lower electrode 171 may be within a range of 20 to 500 nm.

The lower electrode 171 may be individually provided for each of the respective individual liquid chambers 14 or alternatively, the lower electrode 171 may be widely provided on the diaphragm 16. The lower electrode 171 may be connected to the drive circuit 41 via the lead wiring 19 and the common electrode wiring 25. The upper electrode 173 is individually provided for each of the individual liquid chambers 14, and is connected to the drive circuit 41 via the respective lead wiring 19 (individual electrode wiring).

The method of forming the electrode pattern is not specifically limited, but photolithography may be used, for example.

The piezoelectric body 172 is formed between the upper electrode 173 and the lower electrode 171. The piezoelectric body 172 is individually provided for each of the individual liquid chambers 14. The material of the piezoelectric body 171 may be arbitrarily selected from materials that show piezoelectric characteristics. For the piezoelectric body 171, for example, lead zirconate titanate (PZT) may be used because it is widely used as an industrial purpose, various materials and methods of processing exist for PZT, it has good temperature characteristics and it has high piezoelectric characteristics.

The piezoelectric characteristics required for the piezoelectric body 172 depend on required discharging efficiency, but piezoelectric constant $d_{31}$ may be −100 to −150 μm/V. With this range, the discharging efficiency can be retained enough.

The thickness of the piezoelectric body 172 may be arbitrarily determined, however, may be within a range of 0.5 to 5 μm. When the thickness is more than or equal to the above lower limit, dielectric breakdown against the drive voltage can be suppressed. Further, when the thickness is less than or equal to the above upper limit, productivity can be retained and generation of cracks can be suppressed so that failure of the piezoelectric actuator 17 is effectively suppressed.

The piezoelectric body 172 may be deposited and patterned by known techniques such as a subtractive process typically photolithography, or an additive process typically printing.

The subtractive process includes a dry deposition method such as sputtering, or a wet process in which solution of organic metal compound is coated by spin-coating or the like and then baked. The wet process may be preferably used as its productivity is high. Patterning of the piezoelectric body 172 may be performed by known photolithography. By the subtractive process, the piezoelectric characteristics of the piezoelectric bodies 172 can be made constant because the thickness can be retained constant and accuracy in patterning is high.

The additive process includes a wet process in which the piezoelectric bodies 127 are formed at necessary areas by printing. For the printing, an arbitrary method such as ink-jet process, screen printing, gravure printing, flexographic printing, micro-contact printing or the like may be used. In order to form a thick piezoelectric body 127, screen printing may be used. Further, ink-jet process may be preferably used as it is unnecessary to form a template.

Regardless of the method of depositing or patterning, the piezoelectric body 172 is baked in order to crystallize. The temperature condition may be a heat treatment at 500 to 800° C. By crystallization, the piezoelectric characteristics can be improved and discharging efficiency can be increased.

Further, in order to increase environmental durability (reliability) of the piezoelectric actuator 17, a protection film may be formed. The material of the protection film is not specifically limited, but a high gas barrier insulating material may be used.

Then, the lead wirings 19 are formed to apply drive voltage to the piezoelectric bodies 172 from outside, respectively.

The material of the lead wiring 19 may be any conductive materials, but a low resistance material may be preferably used in order to prevent heat generation at a wiring portion and voltage drop by wiring resistance. For such a wiring material, specifically, metal or alloy may be preferably used. More specifically, for example, Al, Au, Ag, Cu, Pt, Ti, Ta, W, or alloy material including such metal as a main constituent may be preferably used. Further, Al or alloy including Al as main constituent that are generally used in a semiconductor device may be preferably used when considering a reliability such as electromigration, ion migration or the like, the cost of the material, or the like.

The thickness of the lead wiring 19 may be determined in accordance with a necessary wiring resistance. By making the thickness thicker, resistance can be lowered with smaller wiring area. The thickness of the lead wiring 19 may be within a range of 0.2 μm to 5.0 μm and more preferably, may be within a range of 1.0 μm to 4.0 μm.

The method of depositing the lead wirings 19 is not specifically limited and an arbitrary thin film forming method may be used. For example, a method that is generally used for a semiconductor device may be used such as sputtering, vapor deposition, CVD method or the like.

The lead wirings 19 may be patterned by any method, however, photolithography may be used. For example, the lead wirings 19 may be patterned by etching process, lift-off or the like. Further, by providing another metal/alloy conductive compound below or above the layer of the lead wirings 19 that is explained above, reliability of the lead wirings 19 can be further increased.

Further, as illustrated in FIG. 1, the interlayer insulating film 22 may be provided below the lead wirings 19 (wiring layer) between the lower electrode 171. In such a case, the lead wirings 19 may be electrically connected with the upper electrode 173 and/or the lower electrode 171 via contacts in contact halls provided in the interlayer insulating film 22.

Then, the interlayer insulating film 23 as illustrated in FIG. 1 may be formed on the lead wirings 19. The interlayer insulating film 23 may have a passivation function that protects the lead wirings 19 from a chemical damage such as corrosion or the like.

The material of the interlayer insulating films 22 and 23 may be any insulating material, but metallic oxide or metallic nitride such as $SiO_2$, $Si_3N_4$, AlN, $Al_2O_3$, $ZrO_2$, $Y_2O_3$, $TiO_2$, TiN or the like may be preferably used.

Here, in order to expose the lead wiring 19 at the respective drive circuit connecting portion 18, the interlayer insulating film 23 at the drive circuit connecting portion 18 is previously removed by etching or the like.

As described above, the support substrate 12 is bonded to the passage substrate 11. The height of the support substrate adhering region 20 between the support substrate 12 and the passage substrate 11 may be substantially constant. For the cross-sectional structure illustrated in FIG. 1, the support substrate 12 and the passage substrate 11 are bonded at portions near the lead wirings 19 and near the ink supplying passage 13. Thus, these portions are the support substrate adhering region 20. These regions have the same stacked structure including the passage substrate 11, the diaphragm 16, the interlayer insulating film 22, the lead wirings 19 (or the common electrode wiring 25) and the interlayer insulating film 23 stacked in this order. Thus, with this structure, the height of the passage substrate 11 at the support substrate adhering region 20 is substantially uniform so that adhesion force can be improved and generation of adhesion voids can be reduced.

(Support Substrate)

As described above, the passage substrate 11 may be silicon wafer thickness of which 40 to 100 μm. In this case, as the thickness is thin, intensity may not be enough. Thus, the support substrate 12 is bonded to the passage substrate 11.

Further, as the piezoelectric actuator 17 is only formed by thin films such as the diaphragm 16, the lower electrode 171, the piezoelectric body 172, the upper electrode 173 and the like, it is preferable to protect the piezoelectric actuator 17 from physical and chemical damages. As a lower surface of the passage substrate 11 is protected by the nozzle plate 10, the support substrate 12 is provided to protect an upper surface of the passage substrate 11.

The material of the support substrate 12 is not specifically limited and may be arbitrarily selected based on required intensity, processability or the like. For example, materials such as glass, ceramics or the like may be preferably used.

When a Si wafer is used as the passage substrate 11, a Si wafer may be used for the support substrate 12 as well. When the same material, for example, the Si wafer, is used for both of the passage substrate 11 and the support substrate 12, the thermal expansion coefficient can be the same. Thus, generation of warping during heat treatment in processing, or due to temperature change after mounting on a printer can be suppressed. Further, by using the Si wafer as the support substrate 12, high productivity can be obtained as various processing methods that are already established in a semiconductor manufacturing process can be used.

The thickness of the support substrate 12 is not specifically limited and may be arbitrarily determined based on required intensity and processability. Here, if the thickness is too thick, productivity is lowered when forming through holes for the drive circuit connecting portions 18 or the ink supplying passage 13. On the other hand, when the thickness is too thin, the intensity is not enough. If the intensity is not enough, a mechanical damage may occur for both the passage substrate 11 and the support substrate 12 while manufacturing the droplet discharging head or when mounting the droplet discharging head on a printer.

Thus, when Si wafer is used for the support substrate 12, for example, the thickness of the support substrate 12 may be within a range of 300 μm to 700 μm and more preferably, may be within a range of 300 μm to 500 μm. With this range, the intensity and the processability can be retained.

When a general Si wafer with ϕ100 to 200 mm is used, by setting the thickness within the above range, the support substrate 12 can have enough intensity and as an etching technique to form through holes for the Si wafer with such a thickness is established, productivity can be retained high.

The support substrate 12 of the embodiment is provided with through holes, at least corresponding to the drive circuit connecting portions 18 and the ink supplying passage 13, in other words, the support substrate 12 is provided with through holes that correspond to the drive circuit connecting portions 18 and the ink supplying passage 13 when being formed into the droplet discharging head.

The drive circuit connecting portion 18 is a portion to input a drive signal to the respective piezoelectric actuator 17. As illustrated in FIG. 4A and FIG. 4B, the drive circuit connecting portion 18 is a portion to input an electrical signal from an external device such as the drive circuit 41 or the like (printer control circuit, for example). The support substrate 12 is provided with an opening portion in order to physically connect the drive circuit connecting portions 18 and the external device.

The ink supplying passage 13 is provided for supplying ink to the individual liquid chambers 14 communicating with the nozzles 15, respectively. The ink supplying passage 13 is formed by providing an opening portion to the support substrate 12. The ink supplying passage 13 may be connected to an ink supply source such as an ink tank or the like, not illustrated in the drawings, by an arbitrary method.

Further, as illustrated in FIG. 1, there is provided the concave vibration room 21 at an adhering surface of the support substrate 12 with the passage substrate 11 near the piezoelectric actuators 17. The vibration room 21 is formed to have a size and a shape that does not influence the deformation of the piezoelectric actuators 17.

The size of the vibration room 21 is not specifically limited, but the vibration room 21 may have a depth more than or equal to 1 μm, and more preferably, more than or equal to 10 μm as the displacement of the unimorph type piezoelectric actuator is about 0.05 to 1 μm. When the depth of the vibration room 21 is more than or equal to the above lower limit, interference when adhering the support substrate 12 to the passage substrate 11, entering of the adhesive agent into the piezoelectric actuators 17 by capillary attraction can be prevented.

Further, when coating an adhesive agent to the support substrate 12 side to bond the support substrate 12 to the passage substrate 11, the vibration room 21 needs to have a sufficient depth such that the vibration room 21 is not filled by the adhesive agent. Thus, the depth of the vibration room 21 may be more than or equal to 10 μm.

On the other hand, when the depth of the vibration room 21 is too deep, processing time becomes long and productivity is lowered. Further, the intensity of the support substrate 12 is lowered. Thus, in this point of view, the depth of the vibration room 21 may be less than or equal to 50% of the thickness of the support substrate 12.

Then, bonding of the passage substrate 11 and the support substrate 12 is explained.

The method of bonding the passage substrate 11 and the support substrate 12 is not specifically limited, but the passage substrate 11 and the support substrate 12 may be bonded by an adhesive agent. The adhesive agent is not specifically limited, and any materials may be used in accordance with the materials of the adhering surfaces, bonding intensity, coating properties or the like.

For example, the adhesive agent may be arbitrarily selected from adhesive agents that are generally used in a semiconductor manufacturing process such as epoxy-based resin, urethane-based resin, silicone-based resin, acrylic-based resin or the like.

The method of curing the adhesive agent is not specifically limited, and may be appropriately selected based on the material or the structure, such as heat curing, photo-curing such as ultraviolet curing, infrared curing or the like, electron radiation curing or the like.

The method of coating the adhesive agent may be arbitrarily selected based on the material characteristics, and various methods such as spin-coating, printing, a method using a dispenser or the like may be used.

An adhering apparatus for adhering and pressing the passage substrate 11 and the support substrate 12 may be arbitrarily selected. When the passage substrate 11 and the support substrate 12 are made of Si wafers, an adhering apparatus for wafer level package may be used.

When adhering the passage substrate 11 and the support substrate 12, the thickness of an adhesive agent layer above the lead wirings 19 may be thinner than the thickness of an adhesive agent layer at a wiring space between the adjacent lead wirings 19 such that a space is not generated between the passage substrate 11 and the support substrate 12, at the support substrate adhering region 20.

Next, the structure of the lead wirings 19 of the droplet discharging head of the embodiment is explained.

As described above, in the droplet discharging head of the embodiment, the wiring space between the adjacent lead wirings 19 is formed to have a crank portion at the support substrate adhering region that is the support substrate adhering region 20 of the passage substrate 11 at which the support substrate 12 is adhered to the passage substrate 11 and including area where the lead wirings 19 are formed.

The specific structure is explained with reference to FIG. 5 and FIG. 6.

Figure 5:
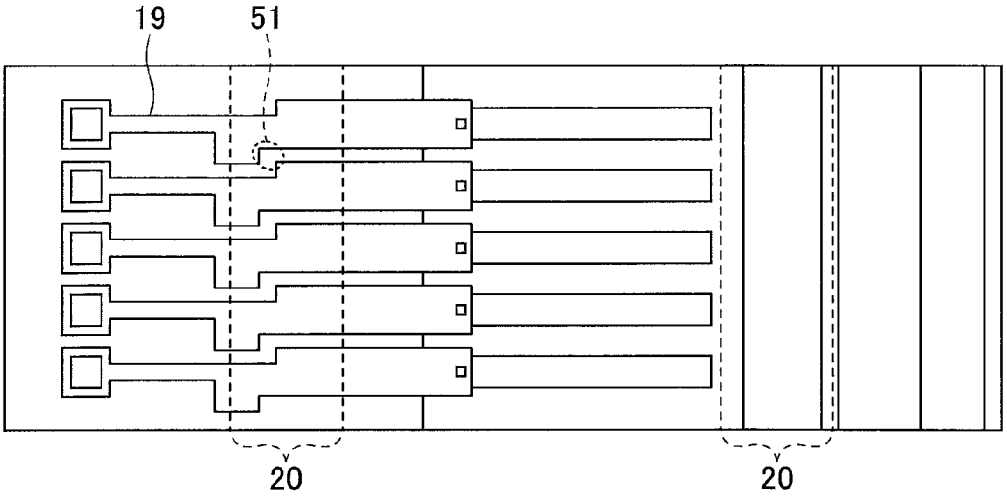
FIG. 5 is a view illustrating an example of a structure of lead wirings at a support substrate adhering region of a first embodiment.
Figure 6:
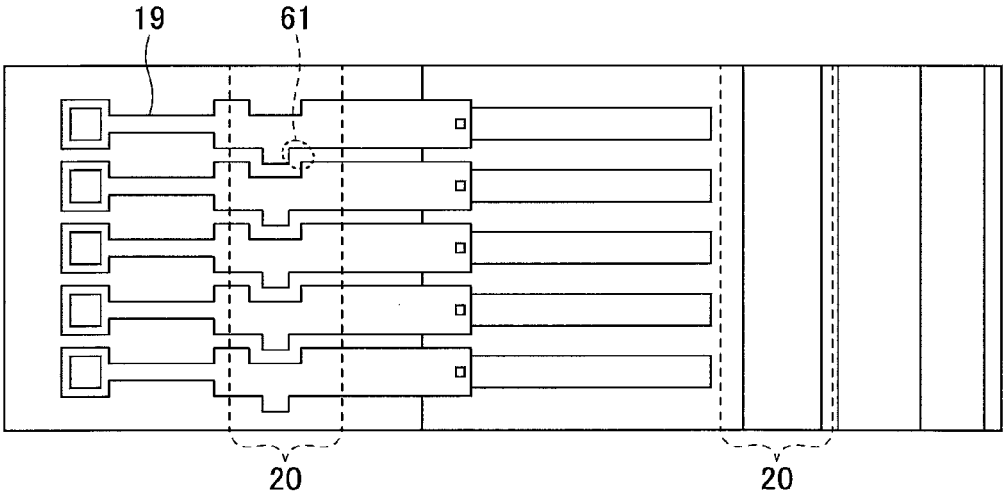
FIG. 6 is a view illustrating another example of a structure of the lead wirings at the support substrate adhering region of the first embodiment.

As illustrated in FIG. 5 or FIG. 6, the lead wirings 19 are formed such that there is provided at least a crank portion 51 or 61 in a wiring space between the adjacent lead wirings 19 at the support substrate adhering region 20. Here, the crank portion means a bent portion.

Thus, there are provided two crank portions in the wiring space between the adjacent lead wirings 19 for the lead wirings 19 illustrated in FIG. 5. There are provided four crank portions in the wiring space between the adjacent lead wirings 19 for the lead wirings 19 illustrated in FIG. 6. As such, by designing the wiring space between the adjacent lead wirings 19 to have the crank portion, the flow of the adhesive agent is trapped at the crank portion so that the flow of the adhesive agent to the drive circuit connecting portion 18 and to the vibration room 21 side can be prevented. As a result, at least the adhesive agent at the crank portion does not flow out, the adhesive agent at the crank portion can block a path between the drive circuit connecting portion 18 and the vibration room 21. Further, as the flow of the adhesive agent is trapped at the crank portion, the adhesive agent can be retained in the wiring space between the adjacent lead wirings 19 and the thickness of an adhesive layer can be thicker at the wiring space. Thus, generation of the space between the support substrate 12 and the passage substrate 11 due to the wiring step can be suppressed.

Figure 7:
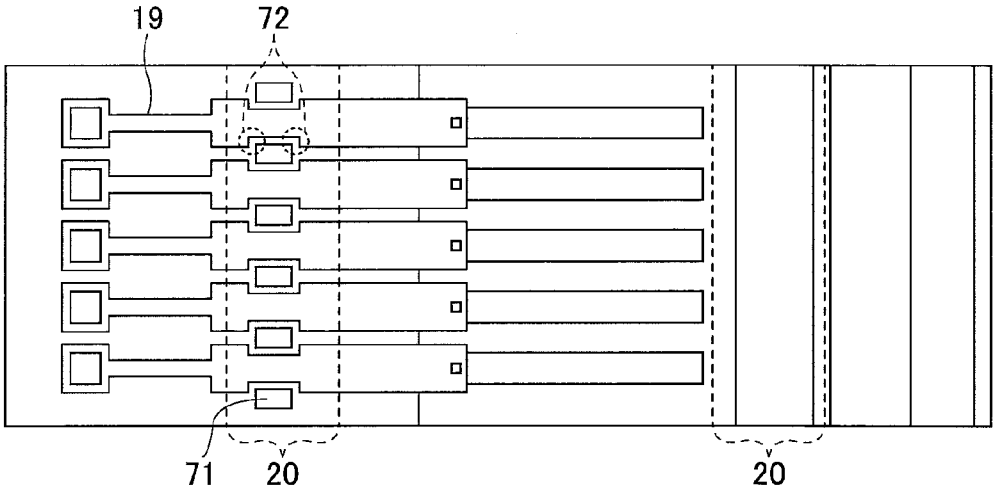
FIG. 7 is a view illustrating another example of a structure of the lead wirings at the support substrate adhering region of the first embodiment.

Here, the structure that "there is provided a crank portion in the wiring space between the adjacent lead wirings 19" means that the wiring space includes a bent portion or the wiring space is formed to bend. Thus, the design pattern of the lead wirings 19 to have the wiring space between the adjacent lead wirings 19 having a crank portion is not limited to those illustrated in FIG. 5 or FIG. 6. For example, as illustrated in FIG. 7, island portions 71 having the same thickness as the lead wirings 19 may be provided at the wiring spaces between the adjacent lead wirings 19, respectively. In this case as well, the wiring space between the adjacent lead wirings 19 is provided with crank portions 72.

The bending angle of the crank portion is not specifically limited, and may be selected based on the physical properties such as the material properties of the adhesive agent, wetting of the substrates or wiring materials, or the like, or a method of pattering the lead wirings 19.

Figure 8:
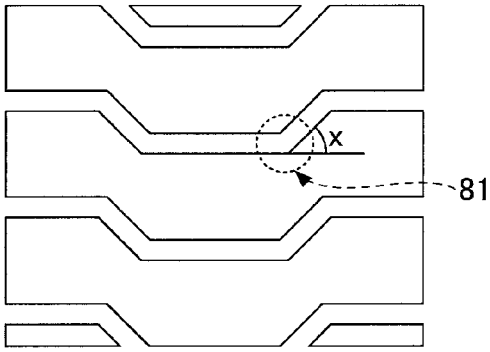
FIG. 8 is an enlarged view illustrating another example of a structure of the lead wirings at the support substrate adhering region of the first embodiment.

FIG. 8 is an enlarged view illustrating another example of a structure of the lead wirings 19 at the support substrate adhering region 20.

In FIG. 8, a bending angle "x" of a crank portion 81, in other words, a crank angle "x" may be arbitrarily selected, as described above.

For example, when photolithography (a wiring patterning method used in a semiconductor manufacturing process) is used when forming the lead wirings 19, it is appropriate that the crank angle is nearly 90°. Specifically, the crank angle may be within a range between 80° to 135°, for example.

When the crank angle is less than or equal to the above upper limit range (135°), the shape of the lead wiring 19 can be stably retained. Further, even when potential difference occurs between the adjacent lead wirings 19, dielectric breakdown such as discharge or the like due to electric field concentration can be prevented. Further, when the crank angle is more than or equal to the above lower limit range (80°), the effect of preventing the flowing out of the adhesive agent can be appropriately retained.

Figure 9:
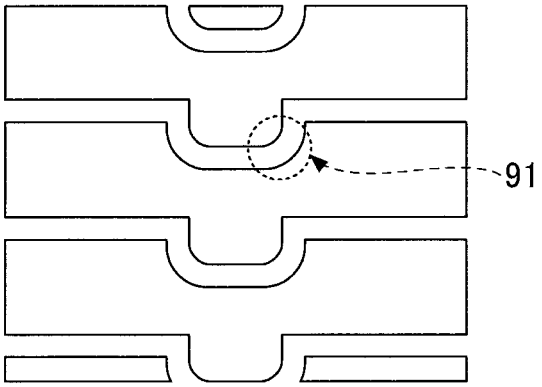
FIG. 9 is an enlarged view illustrating another example of the lead wirings at the support substrate adhering region of the first embodiment.

Further, the shape of the crank portion may be curved as a crank portion 91 illustrated in FIG. 9. In FIG. 9, the crank portion 91 is formed to have a curvature (R) or chamfered (C). As such, by forming the crank portion to be curved, the shape of the lead wiring 19 at corners can be made uniform so that the flow condition of the adhesive agent can be constant. Further, even when potential difference occurs between the adjacent lead wirings 19, dielectric breakdown such as discharge or the like due to electric field concentration can be suppressed.

In the droplet discharging head of the embodiment, the space between the lead wirings 19 at the support substrate adhering region 20 may be as narrow as possible, and may be at least narrower than the wiring width of the lead wiring 19.

Figure 10:
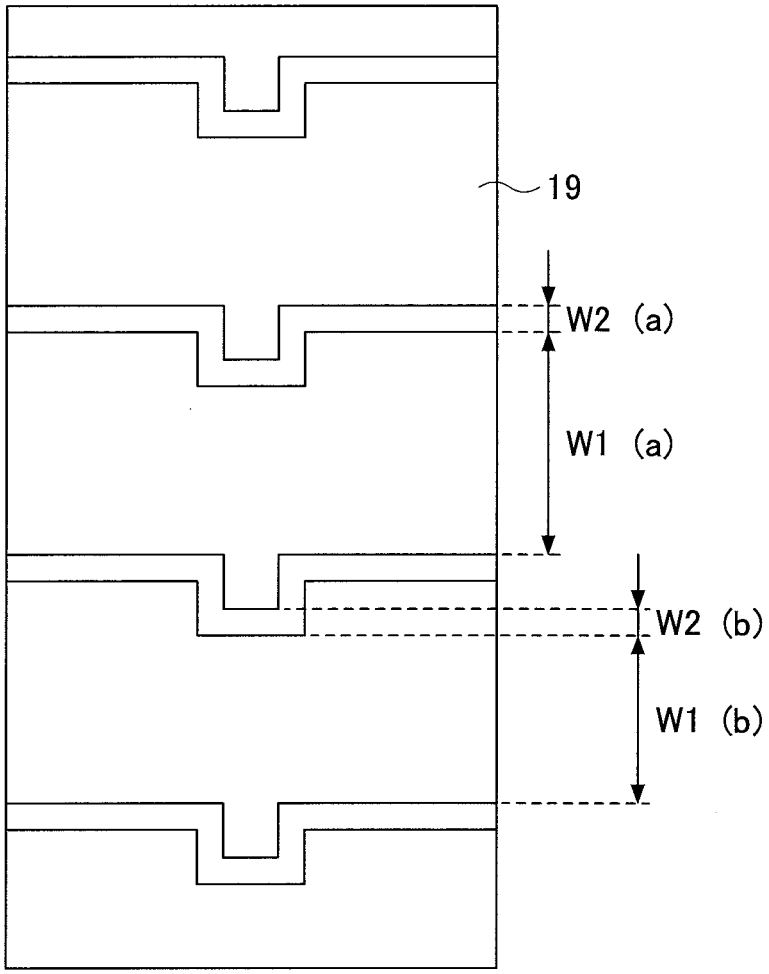
FIG. 10 is an enlarged view illustrating another example of the lead wirings at the support substrate adhering region of the first embodiment.

This structure is explained with reference to FIG. 10 that illustrates an enlarged view of the wiring portion at the support substrate adhering region 20. As illustrated in FIG. 10, the wiring width W1 of the lead wiring 19 may be wider than the wiring space W2 between the adjacent lead wirings 19 at the support substrate adhering region 20.

Here, there are two kinds of the wiring spaces (expressed as W2(*a*) and W2(*b*)) between the adjacent lead wirings 19 and two kinds of the wiring widths (expressed also as W1(*a*) and W1(*b*). At least one kind of the wiring space may satisfy the above condition with respect to at least one kind of the wiring width, and more preferably, both (or all) kinds of the wiring spaces may satisfy the above condition with respect to both (or all) kinds of the wiring spaces, respectively. Further, at this time, the wiring width or the wiring space indicates the maximum value of the wiring width or the wiring space at the support substrate adhering region 20, respectively.

The wiring space W2 is not specifically limited and may be selected based on an accuracy of wiring patterning, dielectric strength between electrodes, or leak current amount. Wiring space W2 may be more than or equal to 2 μm, for example, and more preferably, more than or equal to 5 μm.

When the number of crank portions is large, the sealing effect by the wiring space can be improved. However, when the number of the crank portions is too large, the wiring length, the wiring width or the like of the lead wiring 19 is limited and it may be difficult to actualize a high-density piezoelectric actuator or a small size droplet discharging head.

The wiring space between the adjacent lead wirings 19 may have more than or equal to two crank portions at the support substrate adhering region 20. Further, the wiring space between the adjacent lead wirings 19 may have two to four crank portions at the support substrate adhering region 20. FIG. 5 illustrates an example where the number of the crank portions is two and FIG. 6 and FIG. 7 illustrate an example where the number of the crack portions is four.

The ratio W2/W1 of the wiring space W2 between the adjacent lead wirings 19 with respect to the wiring width W1 of the lead wiring 19 at the support substrate adhering region 20 may be substantially the same for all of the lead wirings 19 in the droplet discharging head.

In particular, the ratio W2/W1 may be within a range of 0.05 to 0.3, and, more preferably, may be within a range of 0.1 to 0.2 in the droplet discharging head.

As described above, for the example illustrated in FIG. 10, there are two kinds of the wiring spaces W2 (expressed as (a) and (b)) between the adjacent lead wirings 19. In this case, each of the wiring spaces W2 may satisfy the above described range of the ratio W2/W1.

Further, for an area at the support substrate adhering region 20 where it is unnecessary to provide the lead wirings 19, dummy wiring patterns having a width same as the wiring width W1 and a space same as the wiring space W2 may be provided.

With the above structure, a surface shape of the passage substrate 11 can be constant along the entirety of the support substrate adhering region 20. Thus, the flow of the adhesive agent can be constant along the entirety of the support substrate adhering region 20 and generation of the space due to the wiring step can be prevented for the entirety of the support substrate adhering region 20.

The wiring structure of the embodiment has an advantage for a case in which the drive circuit 41 is provided on the support substrate 12 or on the passage substrate 11 as illustrated in FIG. 4A and FIG. 4B, respectively. A structure in which the drive circuit 41 is mounted by flip chip as illustrated in FIG. 4B is explained in the following.

A bump 42*b* is formed on the passage substrate 11 at the drive circuit connecting portion 18. A bump 42*c* is formed on the drive circuit 41 at a position corresponding to the bump 42*b* of the passage substrate 11. Then, by bonding the bump 42*b* and the bump 42*c*, the drive circuit 41 and the lead wiring 19 (individual electrode wiring and/or common electrode wiring) are connected. The bump 42*b* and the bump 42*c* may be plating bumps or stud bumps. For the bump 42*b* and the bump 42*c*, any metal/alloy materials may be used. In particular, Au bump or a bump whose surface is plated by Au may be used. In this case, connecting reliability can be increased and the bumps 42*b* and 42*c* can be bonded at a low temperature with a low load.

Then, after mounting the drive circuit 41 as such, the space between the lower surface of the drive circuit 41 and the upper surface of the passage substrate 44, where the bumps 42*b* and 42*c* are provided, is filled with the sealing material 43 to protect the bumps 42*b* and 42*c*. With this, mounting reliability can be increased by protecting the bonding portion from a physical damage (stress) or a chemical damage (corrosion or migration).

Generally, as the height of the space between the drive circuit 41 and the passage substrate 11 is narrow such as about a few μm to a few dozen μm, it is necessary to use a sealing material with high permeability, in other words, it is necessary to use a sealing material with low viscosity (a so-called under filling material).

For the wiring structure of the droplet discharging head of the embodiment, as described above, as the generation of the space between the support substrate 12 and the passage substrate 11 is suppressed, the sealing material 43 can be suppressed from entering into the vibration room 21. Further, even when the sealing material 43 enters the support substrate adhering region 20, as the wiring space is formed to have the crank portion, the flow of the sealing material 43 toward the vibration room 21 can be prevented or suppressed as well as the mechanism that the flowing out of the adhesive agent can be prevented.

As described above, according to the droplet discharging head of the embodiment, even when the mount of the adhesive agent is small, generation of the space between the support substrate 12 and the passage substrate 11 due to the wiring step can be suppressed. Further, even when the space due to the wiring step occurs, the flow of the sealing material 43 from the drive circuit connecting portion 18 toward the vibration room 21 can be suppressed.

(Second Embodiment)

In this embodiment, another example of a structure of the droplet discharging head is explained.

As explained above in the first embodiment, the wiring space between the adjacent lead wirings 19 has the crank portion at the support substrate adhering region 20. Thus, the flow of the adhesive agent toward the drive circuit connecting portion 18 and the vibration room 21 side can be prevented. Further, generation of the space between the support substrate 12 and the passage substrate 11 due to the wiring step can be suppressed and the flow of the sealing material to enter into the vibration room 21 can be also suppressed.

However, when adhering the support substrate 12 to the passage substrate 11, if an adhesive agent with extremely high flowability such as a thermoset adhesive agent, for example, is used, the adhesive agent may flow toward the drive circuit connecting portion 18 side where the support substrate 12 is not adhered, depending on the amount of the adhesive agent or the like. If the adhesive agent flows toward the drive circuit connecting portion 18 side where the support substrate 12 is not adhered and the adhesive agent, which is an insulating body, is adhered to the drive circuit connecting portion 18, connection with the drive circuit 41 may be cut (or cause connection error) or become high resistance. If the connection is cut, this phenomenon can be detected at an initial drive test, however, for the high resistance connection, it is difficult to detect at the initial drive test. Thus, characteristics failure such as increasing of temperature while driving may occur. Thus, it is important to surely prevent the flow of the adhesive agent toward the drive circuit connecting portion 18 side in addition to preventing flow of the sealing material 43 or the adhesive agent toward the vibration room 21 in order to further improve the reliability of the droplet discharging head.

Thus, in the droplet discharging head of the embodiment, the wiring space of the adjacent lead wirings 19 at a region 110 between the support substrate adhering region 20 and the drive circuit connecting portions 18 may have a portion whose width is wider than that of the wiring space of the adjacent lead wirings 19 at the support substrate adhering region 20. Here, the wiring space of the adjacent lead wirings 19 at the support substrate adhering region 20 means the maximum value of the wiring space of the adjacent lead wirings 19 at the support substrate adhering region 20 at the support substrate adhering region 20.

A structure of the droplet discharging head of the embodiment is explained with reference to FIG. 11.

Figure 11:
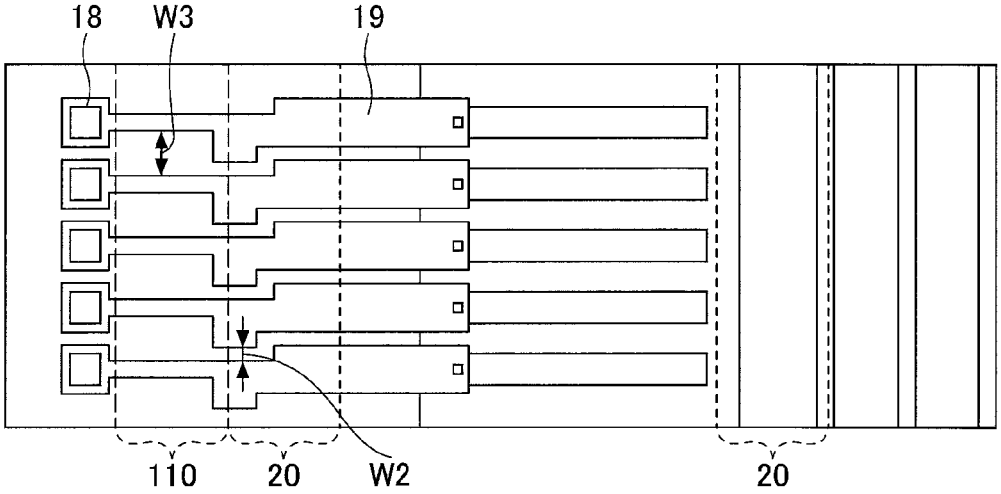
FIG. 11 is a view illustrating an example of a structure of the lead wirings at the support substrate adhering region of a second embodiment.

FIG. 11 is a view for explaining the structure of the lead wiring 19 of the droplet discharging head of the embodiment. FIG. 11 is a cross-sectional view taken along the B-B' line in FIG. 1.

As described above, there is the region 110 where the support substrate 12 is not adhered between the support substrate adhering region 20 and the drive circuit connecting portion 18 illustrated in FIG. 11. This is because there is provided the opening portion at the support substrate 12 at a portion where the drive circuit 41 is mounted and the drive circuit 41 is mounted at the opening portion and the sealing material 43 is injected from the opening portion.

When adhering the support substrate 12 to the passage substrate 11 before mounting the drive circuit 41 on the passage substrate 11, the adhesive agent flows the wiring space of the adjacent lead wiring 19 by capillary attraction. Thus, by providing the wider portion at the region 110 between the support substrate adhering region 20 and the drive circuit connecting portions 18, the flow of the adhesive agent toward the drive circuit connecting portion 18 can be prevented as the wider portion can function as a reservoir of the adhesive agent. For example, as illustrated in FIG. 11, by providing the wider portion whose wiring space W3 is wider than that of the wiring space W2 at the support substrate adhering region 20, at the region 110, the flow of the adhesive agent toward the drive circuit connecting portion 18 can be surely prevented.

In the droplet discharging head of the embodiment, the method of forming the wiring space of the adjacent lead wirings 19 at the region 110 between the support substrate adhering region 20 and the drive circuit connecting portions 18 wider than that at the support substrate adhering region 20 is not specifically limited. For example, as illustrated in FIG. 11, the wiring space W3 may be made wider by narrowing the wiring width of each of the lead wirings 19 at the region 110 between the support substrate adhering region 20 and the drive circuit connecting portions 18.

Figure 12:
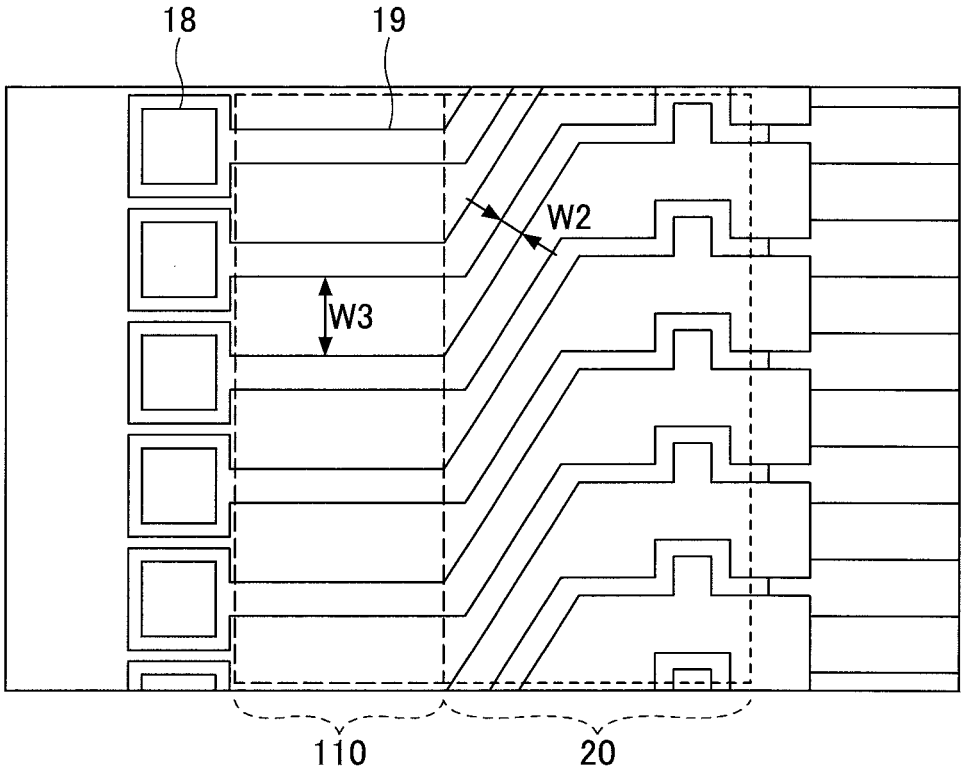
FIG. 12 is an enlarged view illustrating another example of a structure of the lead wirings at the support substrate adhering region of the second embodiment.

Further, as illustrated in FIG. 12, the wiring space W3 may be made wider by bending each of the lead wirings 19 at an interface portion between the support substrate adhering region 20 and the region 110 between the support substrate adhering region 20 and the drive circuit connecting portions 18.

FIG. 12 is a view for explaining the structure of the lead wiring 19 of the droplet discharging head of the embodiment. FIG. 12 is an enlarged cross-sectional view of the droplet discharging head taken along the B-B' line in FIG. 1.

In FIG. 12, the lead wiring 19 is provided to extend in an inclined direction at the support substrate adhering region 20 with the wiring space W2, while the lead wiring 19 is provided to extend in a horizontal direction at the region 110 with the wiring space W3. This means that by providing a bending portion at the interface portion between the support substrate adhering region 20 and the region 110, the wiring space of the adjacent lead wirings 19 may be changed. In other words, even when an alignment pitch of the piezoelectric actuators 17 is constant, the width of the wiring space can be varied.

Here, the interface portion between the support substrate adhering region 20 and the region 110 does not mean a strict interface portion of them but may include the area that is in the vicinity of an interface line. In other words, as described above, the region 110 may include a portion at which the wiring space of the lead wirings 19 is wider than the wiring space of the lead wirings 19 at the support substrate adhering region 20.

However, more preferably, the wiring space of the lead wirings 19 may be wider at the region 110 than that at the support substrate adhering region 20 along the entirety of the region 110. Thus, the lead wirings 19 may bend at the interface line between the support substrate adhering region 20 and the region 110.

With the above structure, the flow of the adhesive agent can be suppressed and at the same time, the wiring length at the support substrate adhering region 20 can be longer. Thus, the flow of the sealing material toward the vibration room 21 can be further suppressed.

The droplet discharging head of the embodiment is explained. The droplet discharging head of the embodiment may be the same as that of the first embodiment except the structure particularly explained in this embodiment.

(Third Embodiment)

In this embodiment, an image forming apparatus including the droplet discharging head explained above in the first and second embodiments is explained.

Figure 13:
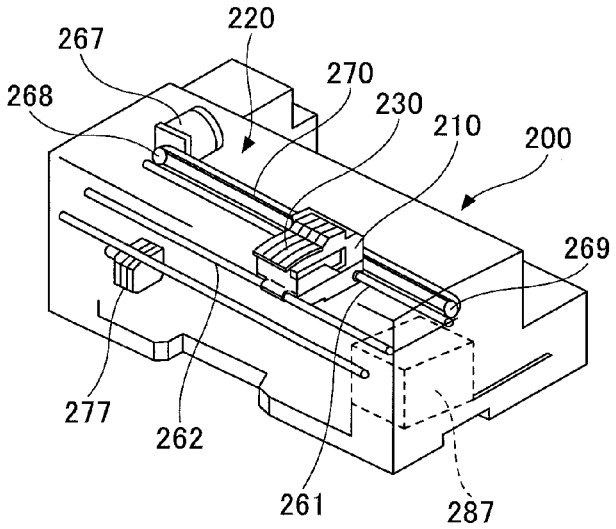
FIG. 13 is a perspective view illustrating an example of a structure of an image forming apparatus of a third embodiment.
Figure 14:
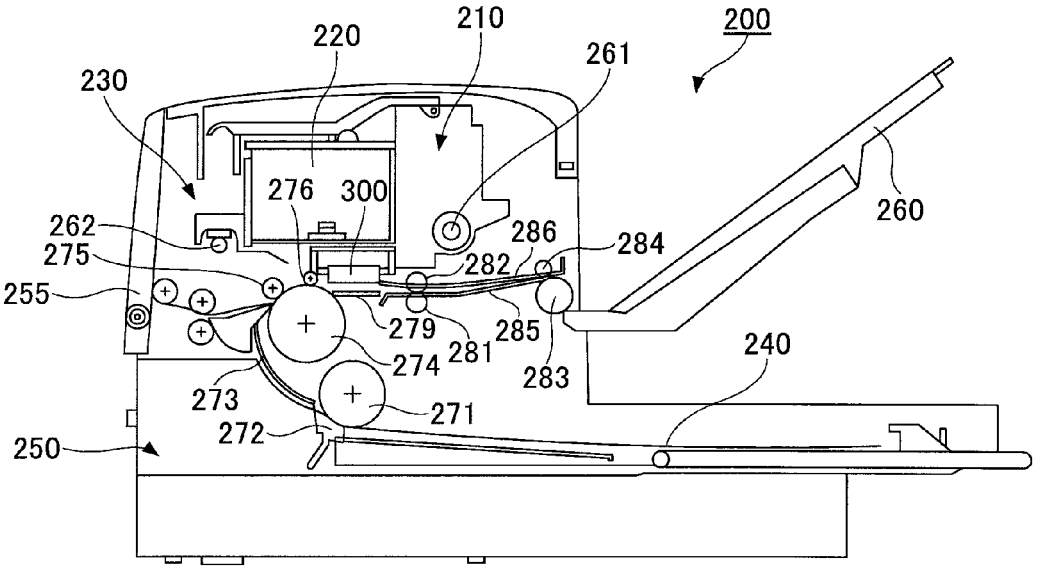
FIG. 14 is a cross-sectional view illustrating an example of the image forming apparatus of the third embodiment.

FIG. 13 is a perspective view schematically illustrating an image forming apparatus 200 of the embodiment. FIG. 14 is a cross-sectional view illustrating the image forming apparatus 200 of the embodiment.

The image forming apparatus 200 of the embodiment includes a droplet discharging head 300.

The image forming apparatus 200 of the embodiment includes its inside a print mechanism unit 230 or the like that includes a carriage 210 movable in a main-scanning direction, the droplet discharging head 300 mounted on the carriage 210, an ink cartridge 220 that supplies liquid (ink) to the droplet discharging head 300 or the like. Further, a paper feeding cassette (paper feeding tray) 250 is detachably mounted at a lower portion of the image forming apparatus 200. Papers 240 may be provided in the paper feeding cassette 250 from its front side.

The image forming apparatus 200 further includes a manual paper feed tray 255 for manually feeding the paper 240. The manual paper feed tray 255 is capable of be opened. The paper 240 is fed into the image forming apparatus 200 from the paper feeding cassette 250 or the manual paper feed tray 255, an image is printed on the paper 240 by the print mechanism unit 230, and the paper 240 is ejected from a paper ejecting tray 260 attached at a back surface side of the image forming apparatus 200.

The print mechanism unit 230 slidably supports the carriage 210 in the main-scanning direction with a guide member including a main guide rod 261 and a sub guide rod 262 that are supported by side plates, not illustrated in the drawings. The droplet discharging heads 300 are attached to the carriage 210 such that the plurality of ink discharging ports (nozzles 15) are aligned in a direction crossing the main-scanning direction and its ink drop discharging direction is directed downward. The droplet discharging heads 300 discharge ink drops of colors of yellow (Y), cyan (C), magenta (M) and black (Bk), respectively.

Ink cartridges 220 for supplying ink of the above colors to the droplet discharging heads 300, respectively, are detachably attached to the carriage 210.

The ink cartridge 220 is provided with an air port for communicating with air at an upper side, a supply port for supplying ink to the droplet discharging head 300 at a lower side, and a porous body filled with ink in its inside. The ink cartridge 220 retains ink to be supplied to the respective droplet discharging head 300 at a slightly negative pressure by capillary attraction of the porous body.

Although the droplet discharging heads 300 each discharges one of the various colors of ink are exemplified here, a single droplet discharging head 300 that includes nozzles 15 for discharging the various colors may be used.

A rear side (downstream in a paper conveying direction) of the carriage 210 is slidably attached to the main guide rod 261 and a front side (upstream in the paper conveying direction) is slidably mounted on the sub guide rod 262.

In order to scan (move) the carriage 210 in the main-scanning direction, a timing belt 270 is provided around a drive pulley 268 that is driven to be rotated by a main-scanning motor 267 and a driven pulley 269. The timing belt 270 is fixed to the carriage 210. By rotating the main-scanning motor 267 in front and back directions, the carriage 210 is reciprocated.

The image forming apparatus 200 further includes a paper feeding roller 271 and a friction pad 272 that separately feed each of the papers 240 set in the paper feeding cassette 250 for conveying the paper 240 toward a lower side of the droplet discharging head 300. The image forming apparatus 200 further includes a guide member 273 that guides the paper 240 and a transfer roller 274 that reverses and conveys the fed paper 240. The image forming apparatus 200 further includes a conveying roller 275 that is pushed to a peripheral surface of the transfer roller 274 and a front edge roller that defines an conveying angle of the paper 240 from the transfer roller 274. The transfer roller 274 is driven to be rotated by the sub-scanning motor 277 via gears.

The image forming apparatus 200 further includes a print receiving member 279, which is a paper guide member, that guides the paper 240 sent from the transfer roller 274 corresponding to a moving range of the carriage 210 in the main-scanning direction at a lower side of the droplet discharging head 300. The image forming apparatus 200 further includes a conveying roller 281 that is driven to be rotated in order to convey the paper 240 toward the ejecting direction and a spur 282 at a downstream side of the print receiving member 279 in the paper conveying direction. The image forming apparatus 200 further includes a paper ejecting roller 283 that conveys the paper 240 to the paper ejecting tray 260, a spur 284, and guide members 285 and 286 that form a paper ejecting path.

When printing, in the image forming apparatus 200, a line of image is formed on a terminated paper 240 by discharging ink by driving the droplet discharging heads 300 in accordance with an image signal while moving the carriage 210, and then, the paper 240 is conveyed for a predetermine amount and then a next line of image is formed.

Upon receiving a print end signal or a signal indicating that a rear end of the paper 240 reaches an image forming area, the printing operation is terminated and the paper 240 is ejected.

There is provided a recovery device 287 at a position outside the image forming area at a right end side in a moving direction of the carriage 210 for recovering a discharging failure of the droplet discharging heads 300. The recovery device 287 includes a capping means, a suction means and a cleaning means. When printing is not performed, the carriage 210 is moved to the recovery device 287 side and the droplet discharging heads 300 are capped by the capping means. By retaining the discharging ports under a set condition, discharging failure due to drying of ink can be prevented.

Further, the image forming apparatus 200 is configured to discharge ink that does not contribute to printing in the middle of printing. With this configuration, ink viscosity at all of the discharging ports can be constant so that the discharging efficiency can be stably retained.

Further, when a discharging error or the like occurs in the image forming apparatus 200, the discharging ports (nozzles 15) of the droplet discharging heads 300 are sealed by the capping means, and bubbles or the like is sucked with ink by the suction means via a tube from the discharging ports. With this, the ink, waste or the like that is attached to the discharging ports can be removed by the cleaning means and the discharging failure can be recovered.

The sucked ink is ejected to a waste ink pool (not illustrated in the drawings) provided at a lower side of the body portion of the image forming apparatus 200, and is retained in an ink absorber in the waste ink pool.

The droplet discharging head 300 of the image forming apparatus 200 of the embodiment is the droplet discharging head explained in the first or second embodiment. With such a droplet discharging head, generation of the space between the support substrate 12 and the passage substrate 11 due to the wiring step can be suppressed. Further, even when the space due to the wiring step occurs, the flow of the sealing material 43 from the drive circuit connecting portion 18 toward the vibration room 21 can be suppressed. Thus, according to the image forming apparatus 200 of the embodiment, image formation can be stably performed.

EXAMPLES

Although specific examples are explained in the following, present invention is not limited to these examples.

Example 1

In this example, the droplet discharging head having a cross-sectional structure as illustrated in FIG. 1 is manufactured by the following method.

(Formation of Piezoelectric Actuators on Passage Substrate)

First, the passage substrate 11 was prepared using a Si wafer with a diameter of 150 mm and with a thickness of 625 μm. Then, a thermal oxidation film with a thickness of 1 μm was formed on the passage substrate 11. Thereafter, $Si_3N_4$ with a thickness of 0.5 μm and $SiO_2$ with a thickness of 0.5 μm were formed on the Si wafer by Chemical Vapor Deposition (CVD) method in this order to obtain the diaphragm 16 with a thickness of 2 μm in total.

Then, Pt with a thickness of 100 nm as the lower electrode 171, lead zirconate titanate (PZT) with a thickness of 2 μm as the piezoelectric body 172, and Pt with a thickness of 100 nm as the upper electrode 173 were formed on the diaphragm 16 by a sputtering method in this order. Then, the product is baked at about 700° C. to crystallize to obtain a piezoelectric body film.

Thereafter, the upper electrode 173 and the piezoelectric body 172 were individualized by photolithography and dry etching to form the piezoelectric actuators 17. The alignment pitch of the piezoelectric actuators 17 was 85 μm, the width of the piezoelectric body 172 was 50 μm, the width of the upper electrode 173 was 40 μm, and the lengths of the piezoelectric body 172 and the upper electrode 173 were 1 mm and 0.99 mm, respectively.

Before forming a wiring layer (lead wirings 19) for applying a drive signal to the piezoelectric actuators 17, $SiO_2$ with a thickness of 0.5 μm was deposited as the interlayer insulating film 22 by CVD method on the piezoelectric actuators 17. Then, contact halls are formed on the upper electrodes 173 and the lower electrode 171.

Then, Al—Si—Cu alloy with a thickness of 3 μm was deposited on the interlayer insulating film 22 by sputtering. Thereafter, the Al—Si—Cu alloy was patterned by photolithography to form the lead wirings 19 (individual electrode wirings and common electrode wiring) and the common electrode wiring 25.

In this example, the lead wirings 19 were formed such that the space between the adjacent lead wirings 19 have the crank structure as illustrated in FIG. 5. Here, the wiring width W1 was 75 μm and the wiring space W2 was 10 μm.

After forming the wirings, $Si_3N_4$ was deposited as the interlayer insulating film 23 by CVD method. Then, $Si_3N_4$ at positions corresponding to the drive circuit connecting portions 18 were removed by an etching process to expose the lead wirings 19 at the drive circuit connecting portions 18. As such, the Si wafer with the piezoelectric actuators 17 was obtained.

(Formation of Support Substrate)

The support substrate 12 was manufactured using a Si wafer with a diameter of 150 mm and with a thickness of 400 μm by photolithography and dry etching. As illustrated in FIG. 1, the opening portion corresponding to the drive circuit connecting portions 18 and the ink supplying passage 13 are formed by forming thorough holes at respective portions in the support substrate 12. Further, a concave portion with a depth of 20 μm as the vibration room 21 is formed in the support substrate 12. For the dry etching, Inductive Coupled Plasma (ICP) etching process (RIE) using an oxide film mask was used.

(Adhering Support Substrate to Si Wafer with Piezoelectric Actuators)

The support substrate 12 and the passage substrate 11 provided with the piezoelectric actuators 17 are bonded by an adhesive agent. As the adhesive agent, two-component epoxy adhesive agent having a high viscosity, viscosity at room temperature is 10 Pa·s was used. The adhesive agent was coated to the support substrate 12 by flexo printing.

Then, the support substrate 12 and the passage substrate 11 provided with the piezoelectric actuators 17 are overlapped, and adhered with each other by heat setting by pressing. The thickness of the adhesive agent after coating was about 2 μm and the thickness of the adhesive agent on the lead wirings after bonding was about 1 μm.

Then, after the thickness of the passage substrate 11 was reduced from 625 μm to 80 μm by mechanical polishing. Then, the individual liquid chambers 14 are formed by dry etching. Thereafter, the adhered body was individualized into pieces each having a size of the droplet discharging head 300 by dicing. The height of the individual liquid chambers 14 is adjusted by the above mechanical polishing.

Then, the nozzle plate 10 made of a SUS substrate with a thickness of 30 μm and provided with the nozzles 15 was adhered to the passage substrate 11. The nozzles 15 were formed by press processing. The nozzle plate 10 was provided with the nozzles 15 at positions corresponding to the individual liquid chambers 14 so that by adhering the nozzle plate 10 to the individualized nozzle plate 10, the droplet discharging head was obtained.

It was confirmed that there is no failure such as the drive circuit connecting portion 18 and the vibration room 21 are in communication with each other by observing the support substrate adhering region 20 of the droplet discharging head where the lead wirings 19 pass as illustrated in FIG. 5, by a microscope using an infrared wavelength that penetrates Si.

Next, as illustrated in FIG. 4B, a driver IC as the drive circuit 41 was mounted by a flip chip connection via an Au stud bump (ϕ20 μm) and under filling material (sealing material 43) was filled. It was confirmed that the sealing material 43 did not enter the vibration room 21 by observing the portion by the microscope using an infrared wavelength that penetrates Si.

Further, after mounting and adhering a common passage member 44 on the support substrate 12, ink was discharged. The drive voltage was measured to be 15 V when the drop speed was 8 m/s.

RELATIVE EXAMPLE

By a method similar to the method of example 1, a droplet discharging head was manufactured.

However, the structure of the lead wirings 19 was as illustrated in FIG. 2B where the crank portion is not provided at the support substrate adhering region 20. The wiring width and the wiring space were 75 μm and 10 μm, respectively, which were the same as those of example 1.

After adhering the support substrate 12 and forming the droplet discharging head by steps similar to those of example 1, the support substrate adhering region 20 of the droplet discharging head illustrated in FIG. 2B was observed by a microscope using an infrared wavelength that penetrates Si. Then, it was confirmed that there is a region where the adhesive agent is not provided at the space between the adjacent lead wirings 19. In other words, it was confirmed that the droplet discharging head illustrated in FIG. 2B had a structure in which the drive circuit connecting portion 18 and the vibration room 21 are communicating with each other.

Further, it was confirmed that a thin film of the adhesive agent was adhered at the periphery of the drive circuit connecting portion 18. The reason for this phenomenon is considered that the viscosity of the adhesive agent at the support substrate adhering region 20 became low during the heat treatment and the adhesive agent flowed the space between the adjacent lead wirings 19 by capillary attraction.

Then, similar to example 1, a driver IC as the drive circuit 41 was mounted by a flip chip connection via an Au stud bump (ϕ20 μm) and under filling material (sealing material 43) was filled. It was confirmed that the sealing material 43 entered the vibration room 21 by observing the portion by the microscope using an infrared wavelength that penetrates Si.

Further, after mounting and adhering a common passage member 44 on the support substrate 12, ink was discharged. The drive voltage was measured to be 18 V, which is about 20% higher than that of example 1, when the drop speed was 8 m/s. The reason for this phenomenon is considered that as the adhesive agent flowed into the vibration room 21, the performance of the piezoelectric actuator was lowered and the discharging efficiency was also lowered.

Examples 2 to 4

As illustrated in table 1, the droplet discharging heads were manufactured and evaluated similarly as example 1 except that the number of crank portions and/or the thickness of the adhesive agent were varied.

For examples 2 and 4, the number of crank portions was four, and the structure of the lead wirings 19 was as illustrated in FIG. 6. For example 3, the number of crank portions was two, and the structure of the lead wirings 19 was as illustrated in FIG. 5. Further, for example 4, the thickness of the adhesive agent was 2 μm, which is the same as example 1. For examples 2 and 3, the thickness of the adhesive agent was 1 μm, which is ½ of that of example 1.

TABLE 1

| | WIRING WIDTH | WIRING SPACE | NUMBER OF CRANK PORTIONS | THICKNESS OF ADHESIVE AGENT | IR MEASUREMENT RESULT AFTER ADHERING HOLDING SUBSTRATE | IR MEASUREMENT RESULT AFTER MOUNTING DRIVE CIRCUIT | DISCHARGE EVALUATION RESULT (DRIVE VOLTAGE) |
|---|---|---|---|---|---|---|---|
| EXAMPLE 1 | 75 μm | 10 μm | 2 | 2 μm | NO COMMUNICATION | NO IMMERSION | 15 V |
| EXAMPLE 2 | 75 μm | 10 μm | 4 | 1 μm | NO COMMUNICATION | NO IMMERSION | 15 V |
| EXAMPLE 3 | 75 μm | 10 μm | 2 | 1 μm | COMMUNICATION | NO IMMERSION | 15 V |
| EXAMPLE 4 | 75 μm | 10 μm | 4 | 2 μm | NO COMMUNICATION | NO IMMERSION | 15 V |
| RELATIVE EXAMPLE | 75 μm | 10 μm | 0 | 2 μm | COMMUNICATION | IMMERSION | 18 V (INCREASED) |

As illustrated in Table 1, after performing evaluations the same as those performed in example 1, it was confirmed that the sealing material did not enter the vibration room 21 after mounting the drive circuit 41 for examples 2 to 4.

Further, by providing four crank portions, the drive circuit connecting portion 18 and the vibration room 21 after adhering the support substrate 12 are prevented from being in communication with each other even when the amount of the adhesive agent was ½ (example 2). Further, it was confirmed that entering of the under filling material (sealing material) was prevented by providing the crank portions.

Further, it was confirmed that the droplet discharging head had sufficient performance for all of examples 1 to 4 by the evaluation of the discharging efficiency (voltage).

According to the embodiments, a droplet discharging head can be provided capable of suppressing generation of a space between a support substrate and a passage substrate due to a wiring step, even when the mount of the adhesive agent is small, and capable of suppressing the flow of a sealing material from a drive circuit connecting portion 18 toward a vibration room even when the space due to the wiring step occurs.

Although a preferred embodiment of the droplet discharging head and the image forming apparatus has been specifically illustrated and described, it is to be understood that minor modifications may be made therein without departing from the spirit and scope of the invention as defined by the claims.

The present invention is not limited to the specifically disclosed embodiments, and numerous variations and modifications and modifications may be made without departing from the spirit and scope of the present invention.

The present application is based on and claims the benefit of priority of Japanese Priority Application No. 2013-054297 filed on Mar. 15, 2013, and Japanese Priority Application No. 2013-218350 filed on Oct. 21, 2013, the entire contents of which are hereby incorporated by reference.

What is claimed is:

1. A droplet discharging head comprising:

a passage substrate in which individual liquid chambers are formed;

a plurality of piezoelectric elements foimed on the passage substrate;

a plurality of wirings for connecting electrodes of the plurality of piezoelectric elements and drive circuit connecting portions for being connected to a drive circuit, respectively, found on the passage substrate; and a support substrate, formed on the passage substrate, provided with a concave portion for housing the plurality of piezoelectric elements at a surface facing the passage substrate, the support substrate being provided with an opening portion above the drive circuit connecting portions, wherein the support substrate is adhered to the passage substrate at a support substrate adhering region of the passage substrate including area where the wirings are formed, and wherein a wiring space between each adjacent wirings is formed to have a crank portion at the support substrate adhering region.

2. The droplet discharging head according to claim 1, wherein the wiring width of each of the wirings is wider than the wiring space between each adjacent wirings at the support substrate adhering region.

3. The droplet discharging head according to claim 1, wherein the wiring space between each adjacent wirings is formed to have two or more crank portions at the support substrate adhering region.

4. The droplet discharging head according to claim 1, wherein a ratio W2/W1 of the wiring space W2 between each adjacent wirings with respect to the wiring width W1 of each of the wirings is substantially the same along the entirety of the droplet discharging head.

5. The droplet discharging head according to claim 1, wherein the support substrate is adhered to the passage substrate by an adhesive agent, and wherein the thickness of a layer of the adhesive agent above each of the wirings is thinner than the thickness of a layer of the adhesive agent at the wiring space between each adjacent wirings.

6. The droplet discharging head according to claim 1, wherein the wiring space between each adjacent wirings at a region between the support substrate adhering region and the drive circuit connecting portion includes a portion whose wiring space is wider than that at the support substrate adhering region.

7. The droplet discharging head according to claim 6, wherein each of the wirings is bent at an interface portion of the support substrate adhering region and the region between the support substrate adhering region and the drive circuit connecting portion.

8. The droplet discharging head according to claim 1, wherein the crank portion of the wiring space between each adjacent wirings is formed at a region between the concave portion and the opening portion of the support substrate.

9. The droplet discharging head according to claim 1, wherein the crank portion of the wiring space is formed at a region that does not overlap the concave portion of the support substrate.

10. An image forming apparatus comprising:

a droplet discharging head including, a passage substrate in which individual liquid chambers are formed, a plurality of piezoelectric elements formed on the passage substrate, a plurality of wirings for connecting electrodes of the plurality of piezoelectric elements and drive circuit connecting portions for being connected to a drive circuit, respectively, formed on the passage substrate, and a support substrate, formed on the passage substrate, provided with a concave portion for housing the plurality of piezoelectric elements at a surface facing the passage substrate, the support substrate being provided with an opening portion above the drive circuit connecting portions, wherein the support substrate is adhered to the passage substrate at a support substrate adhering region of the passage substrate including area where the wirings are formed, and wherein a wiring space between each adjacent wirings is formed to have a crank portion at the support substrate adhering region.

11. The image forming apparatus according to claim 10, wherein the crank portion of the wiring space between each adjacent wirings is formed at a region between the concave portion and the opening portion of the support substrate.

12. The image forming apparatus according to claim 10, wherein the crank portion of the wiring space is formed at a region that does not overlap the concave portion of the support substrate.

* * * * *